US008690295B2

(12) United States Patent
Bengali et al.

(10) Patent No.: US 8,690,295 B2
(45) Date of Patent: Apr. 8, 2014

(54) FLUID NOZZLE ARRAY

(75) Inventors: Sadiq Bengali, Corvallis, OR (US); Chien-Hua Chen, Corvallis, OR (US); Galen P. Cook, Albany, OR (US); Michael W. Cumbie, Albany, OR (US); Robert K. Messenger, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/821,204

(22) PCT Filed: Sep. 15, 2010

(86) PCT No.: PCT/US2010/048976

§ 371 (c)(1), (2), (4) Date: Mar. 6, 2013

(87) PCT Pub. No.: WO2012/036682

PCT Pub. Date: Mar. 22, 2012

(65) Prior Publication Data

US 2013/0162717 A1 Jun. 27, 2013

(51) Int. Cl.
*B41J 2/14* (2006.01)

(52) U.S. Cl.
USPC ..... 347/47

(58) Field of Classification Search
USPC ..... 347/47; 216/27
See application file for complete search history.

(56) References Cited

U.S. PATENT DOCUMENTS

| | | | | |
|---|---|---|---|---|
| 6,394,586 | B2 * | 5/2002 | Isshiki | 347/54 |
| 6,607,259 | B2 | 8/2003 | Mott et al. | |
| 6,938,340 | B2 | 9/2005 | Haluzak et al. | |
| 7,255,425 | B2 | 8/2007 | Lai et al. | |
| 7,566,118 | B2 | 7/2009 | Bibl et al. | |
| 7,637,593 | B2 * | 12/2009 | Silverbrook et al. | 347/47 |
| 8,141,987 | B2 * | 3/2012 | Hayakawa et al. | 347/64 |
| 2003/0058309 | A1 | 3/2003 | Haluzak et al. | |
| 2006/0192808 | A1 | 8/2006 | Hoisingyon et al. | |
| 2008/0295308 | A1 | 12/2008 | Wijngaards et al. | |

FOREIGN PATENT DOCUMENTS

| | | | |
|---|---|---|---|
| KR | 20080033111 | A | 4/2008 |
| KR | 20090058225 | A | 6/2009 |
| TW | I295239 | | 4/2008 |

* cited by examiner

*Primary Examiner* — Lamson Nguyen

(57) ABSTRACT

A method for fabricating a fluid nozzle array includes forming a circuitry layer onto a substrate, the substrate comprising a stopping layer disposed between a membrane layer and a handle layer, forming a fluid feedhole extending from a surface of the membrane layer to the stopping layer, and forming a fluid supply trench extending from a surface of the handle layer to the stopping layer. A fluid nozzle array includes a substrate including a membrane layer, a stopping layer adjacent to the membrane layer, a handle layer adjacent to the stopping layer, and a set of fluid chambers disposed on a surface of the membrane layer above and along a width of a fluid supply trench extending from a surface of the handle layer to the stopping layer.

15 Claims, 9 Drawing Sheets

FLUID NOZZLE ARRAY

BACKGROUND

Inkjet printers are commonly used both for large scale printing, such as on banners and other signage items, as well as for small scale general consumer printing. Inkjet printers typically include a number of ink nozzles configured to eject ink onto a print medium such as paper. The process of ejecting a droplet of ink is often referred to as firing. Ink nozzles are typically fired through use of an ejection mechanism. One type of ejection mechanism is a thermal resistor. The thermal resistor heats ink within a small chamber associated with each nozzle. This causes the ink within the chamber to expand, causing an ink droplet to be propelled from the ink nozzle opening onto the print medium.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
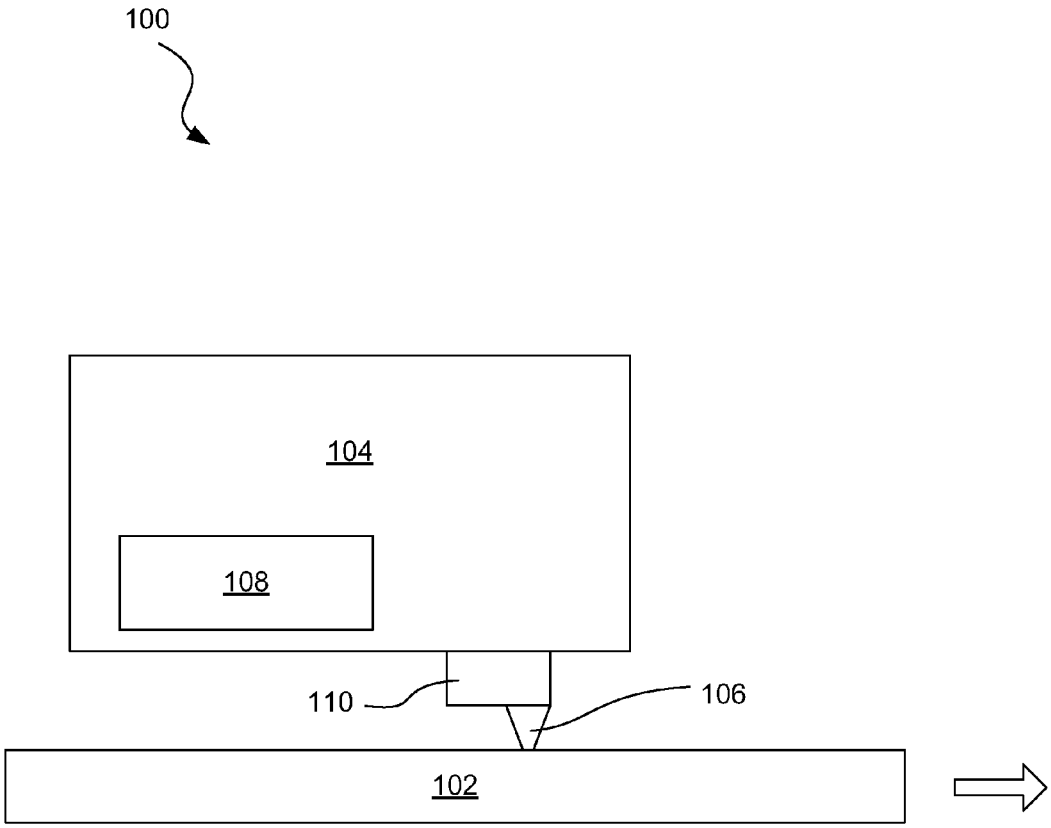
FIG. 1 is a diagram showing an illustrative inkjet printing system, according to one example of principles described herein.

Inkjet printing system developers strive to design printing systems capable of printing high quality images at fast speeds. The density of the ink nozzles on the printhead affects the speed and quality of the printing system. Generally, a higher density array of ink nozzles is able to produce a higher quality image. Additionally, the rate at which the ink nozzles fire affects the speed of the printing system. A higher frequency of ink nozzle firings can produce an image in a smaller period of time. In addition, a higher number of ink nozzles can increase print speed. This can be done by using redundant nozzles with alternating firing. For example, one ink nozzle can be refilling its associated small ink chamber while an alternate ink nozzle is firing.

The ink nozzle density of an ink nozzle array is limited by the structure of the materials forming the array. Particularly, the ink nozzle array is limited by the structure of the wafer in which the small ink chambers associated with each ink nozzle is formed. Additionally, the rate at which ink nozzles are able to be fired is limited by the thermal efficiency of the ink chambers and their associated ink nozzles. The rate at which ink nozzles can be fired is also limited by the rate that each chamber refills with ink after the ink has been fired from that ink chamber.

The present specification discloses an ink nozzle array structure that seeks to address these issues. According to certain illustrative examples, the ink nozzle array embodying principles described herein includes a number of ink nozzles formed on a surface of a semiconductor substrate. The semiconductor substrate includes a membrane layer, a stopping layer, and a handle layer. Throughout this specification and in the appended claims, the term "membrane layer" refers to a layer which is used to support circuitry for a number of ink nozzles. The term "stopping layer" refers to a material used to control an etching process. The term "handle layer" refers to a layer used to provide support for a stopping layer and a membrane layer.

An ink supply trench is formed into the handle layer of the substrate. This leaves the membrane layer and the stopping layer to span across the width of the ink supply trench. The semiconductor membrane layer may be made of a standard semiconductor material such as silicon.

A set of ink chambers is placed on a surface of the membrane layer of the substrate above and along a width of the ink supply trench formed into the handle layer of the substrate. Each ink chamber is able to receive ink through ink feedholes formed through the membrane layer to the ink supply trench below. This set of ink chambers defines one dimension of the two-dimensional array. The second dimension of the ink nozzle array is along the length of the ink supply trench. Additional sets of ink chambers spanning the membrane layer are placed along the length of the ink supply trench. For example, four ink chambers may span the width of the ink supply trench. In one possible example, two hundred of these sets of four ink chambers may be placed along the length of the ink supply trench. This creates a 4×200 ink nozzle array.

As will be described below and illustrated in the figures, without the membrane layer, only a one-dimensional array of ink nozzles may be formed across a single ink supply trench. To form a two-dimensional array without the membrane layer, several small ink supply trenches are placed in parallel and in as close proximity as possible. A single line of ink chambers is then formed adjacent to each side of the ink supply trench. With this structure, the nozzle density is only limited by how tightly the ink chambers can be packed next to the ink supply trench.

In addition, the stopping layer between the membrane layer and the handle layer provides a mechanism for accurately controlling the etching process. A finer control over the etching process allows precise shaping of the ink supply trench and ink feedholes. This finer control provides a more durable and thermally efficient ink nozzle array.

Through use of a substrate with a stopping layer as described herein, a two-dimensional array of ink chambers may be placed above and use the same ink supply trench. The semiconductor material making up the membrane layer allows for circuitry to be formed for connecting to and engaging the ejection mechanism associated with each ink chamber. By having two dimensions of ink chambers placed above and sharing the same ink supply trench, a greater ink nozzle density can be achieved. Additionally, more freedom is given to space the ink nozzles in a thermally efficient manner. Furthermore, the fluid path transporting ink from the ink-supply trench to the ink chamber can be minimized for faster refill.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "ink" is to be interpreted as any type of fluid which can be ejected from an ink nozzle.

Referring now to the figures, FIG. 1 is a diagram showing an illustrative inkjet printer (100). According to certain illustrative embodiments, a print engine (104) of the printer (100) includes a control system (108) and an ink cartridge (110) with a printhead having a number of inkjet ink nozzles (106). The printer (100) typically includes a print medium feeding mechanism that moves a print medium (102) past the ink nozzles (106) of the cartridge (110) as ink is ejected. Additionally or alternatively, the printer (100) may include an ink cartridge carriage that moves the ink cartridge (110) and ink nozzles (106) with respect to the print medium (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the print engine (104). Additionally, the control system (108) may convert the image data sent from a client computing system to a format which is used by the print engine (104).

The ink cartridge (110) may be designed to support several printheads. Each printhead may dispense a different color of ink such that full-color images can be produced. As the ink cartridge (110) moves with respect to the print medium (102) and/or the print medium (102) moves underneath the ink cartridge (110), the control system (108) may send a signal to the appropriate inkjet ink nozzle (106) associated with the printheads of the ink cartridge (110) to eject an ink droplet. Ink droplets are ejected in a specific pattern so as to create an intended image on print medium (102).

Figure 2A:
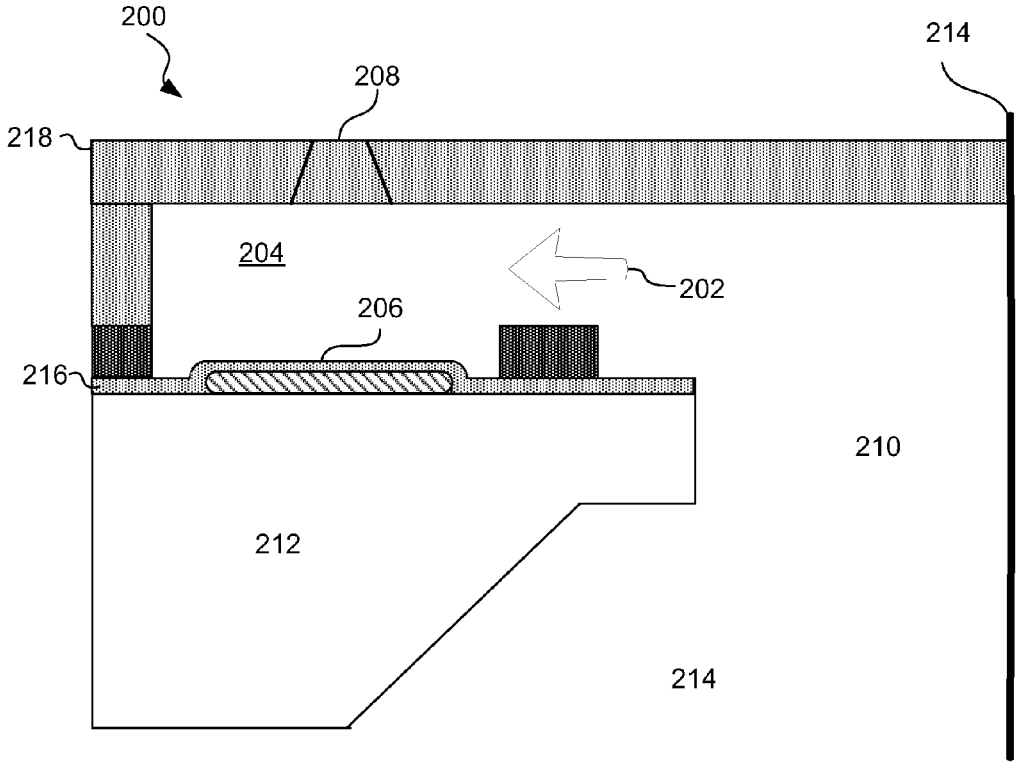
FIG. 2A is a diagram showing an illustrative cross-sectional view of an ink nozzle array, according to one example of principles described herein.

FIG. 2A is a diagram showing an illustrative cross-sectional view of an ink nozzle array (200) without a stopping layer. According to certain illustrative examples, the illustrated ink nozzle array (200) includes a silicon substrate (212) with a circuitry layer (216) deposited thereon. A polymer (218) is then placed over the circuitry layer (216) to form ink chambers (204) and ink nozzles (208). A trench is cut all the way through the silicon substrate (212) to form an ink feedhole (210). The ink feedhole (210) feeds ink chambers arrayed along both sides of the ink supply trench (214) length. FIG. 2A illustrates only one side of the ink supply trench (214). A mirror image of the objects on the left of the mirror axis (214) is positioned on the right side of the mirror axis (214).

Ink nozzle arrays can be built onto a silicon substrate (212) such as a silicon wafer. The use of the silicon material (206) allows electronic circuitry to be formed on a surface of the wafer. This circuitry layer (216) is formed with a number of thin films. The thin films can be layers of dielectric materials, conductive materials and semi-conductive materials. This circuitry is used to select and fire the ink nozzles within the array (200).

An ink nozzle can be fired through a variety of methods. One such method is referred to as thermal inkjet printing. Thermal inkjet ink nozzles are fired when the ink inside the chambers (202) is heated. The ink is heated by a thermal resistor (206). The thermal resistor (206) takes electrical energy received via the circuitry layer (216) and transfers that energy into thermal energy. This thermal energy that is absorbed by the ink within the ink chamber (204) causes some of the ink to vaporize. The vapor bubble propels a droplet of ink through the ink nozzle (208) and onto a print medium such as paper.

After an ink droplet has been propelled out of the ink chamber, the collapsing vapor bubble and capillary forces pull in more ink from an ink supply trench (218) to refill the ink chamber (204). A single ink supply trench (218) supplies multiple ink chambers (204), and those ink chambers are placed along the sides of the trench. The arrow illustrates the direction of ink flow (202).

Figure 2B:
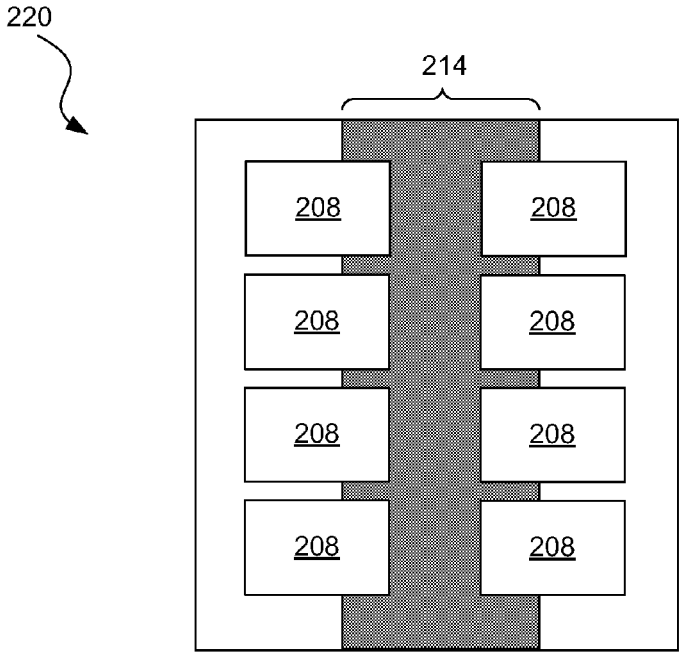
FIG. 2B is a diagram showing an illustrative top view of an ink nozzle array, according to one example of principles described herein.

FIG. 2B is a diagram showing an illustrative top view (220) of an ink nozzle array without a substrate stopping layer. As mentioned above, with the illustrated ink nozzle array structure, ink nozzles and their associated chambers can only be placed in a single dimension along an ink supply trench. This is because the ejection mechanism such as the thermal resistor is placed on a silicon structure. To form a two-dimensional array, a separate ink supply trench must be formed for each line of ink nozzles (208). FIG. 2B illustrates two lines of ink nozzles (208) and their associated ink chambers above an ink supply trench (214).

This structure limits the placement of nozzles to single lines on either side of an ink-supply trench. In light of this issue, the present specification discloses use of a substrate which includes a stopping layer between a membrane layer and a handle layer. As mentioned above, the ink supply trench is formed into the handle layer and the ink chambers are formed on a surface of the membrane layer above and across the width of the ink supply trench. The stopping layer provides a mechanism for finer control of the etching process.

Figure 3A:
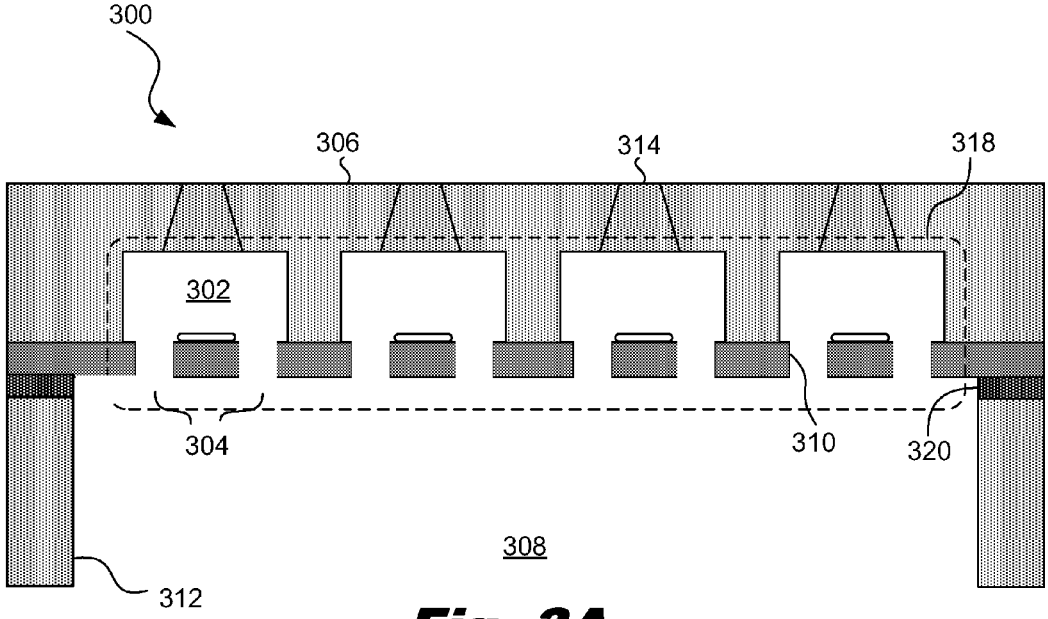
FIG. 3A is a diagram showing an illustrative cross-sectional view of a plurality of ink nozzles within a two-dimensional ink nozzle array, according to one example of principles described herein.

FIG. 3A is a diagram showing an illustrative cross-sectional view of a plurality of ink nozzles (314) within a two-dimensional ink nozzle array (300) which makes use of a substrate with a stopping layer (320) and a membrane layer (310). Use of the semiconductor membrane layer (310) allows for multiple ink chambers (302) to be formed across the width of the ink supply trench (308). The stopping layer (320) allows for finer control over the etching process used to fabricate the ink nozzle array (300). The substrate layer including the membrane layer (310), stopping layer (320), and handle layer (312) will be discussed in more detail below.

FIG. 3A illustrates four ink chambers (302) placed above the semiconductor membrane layer (310) across the width of the ink supply trench (308). These ink chambers (302) spanning the width of the ink supply trench (308) will be referred to as a set (318) of ink chambers (302). The membrane layer (310) allows less constraint in the process of placing the ink chambers (302) above the ink supply trench (308). For example, ink chambers (302) within a set (318) may be placed in closer proximity to one another. Additionally, ink feedholes (304) may be placed on both sides of the ejection mechanism. As will be described in more detail below, this can help increase the thermal efficiency of the ink nozzle array (300) and the rate at which the ink nozzles (314) are able to fire.

Figure 3B:
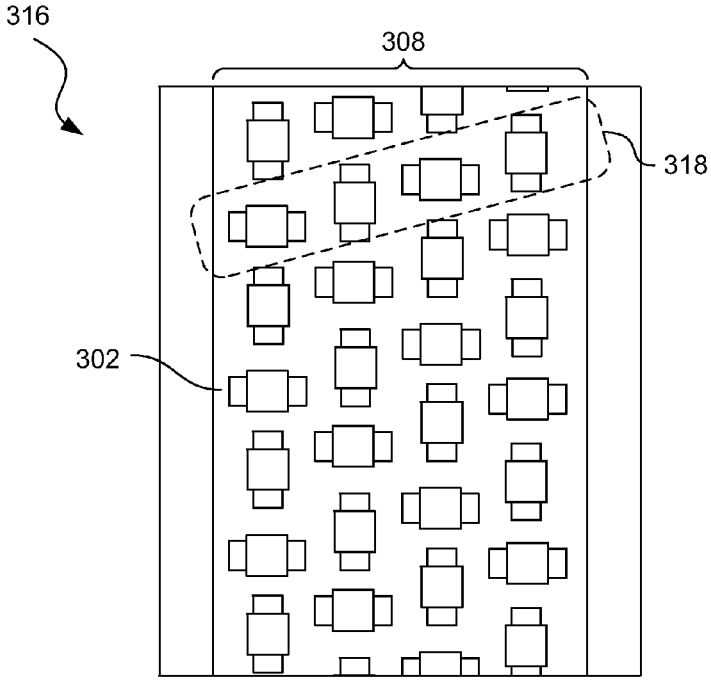
FIG. 3B is a diagram showing a top view of ink nozzles within a two-dimensional array, according to one example of principles described herein.

FIG. 3B is a diagram showing a top view (316) of ink nozzles (314) within a two-dimensional array. FIG. 3B illustrates multiple sets (318) of ink chambers (302) placed on a semiconductor membrane layer (310) above an ink supply trench (308). The multiple sets (318) are placed along the length of the ink supply trench (308).

The pattern of the ink chambers (302) may be designed in a variety of ways to suit various printing systems. For example, the orientation of the chambers may be altered so that the ink feedholes (304) are on different sides of the ejection mechanism. Additionally, a set (318) of ink chambers may span an ink supply trench (308) at an angle as shown in FIG. 3B. These and other benefits are realized through use of the membrane layer. The process of fabricating an ink nozzle array (300) on a substrate which includes a membrane layer (310), a stopping layer (320), and a handle layer (312) will now be described.

Figure 4A:
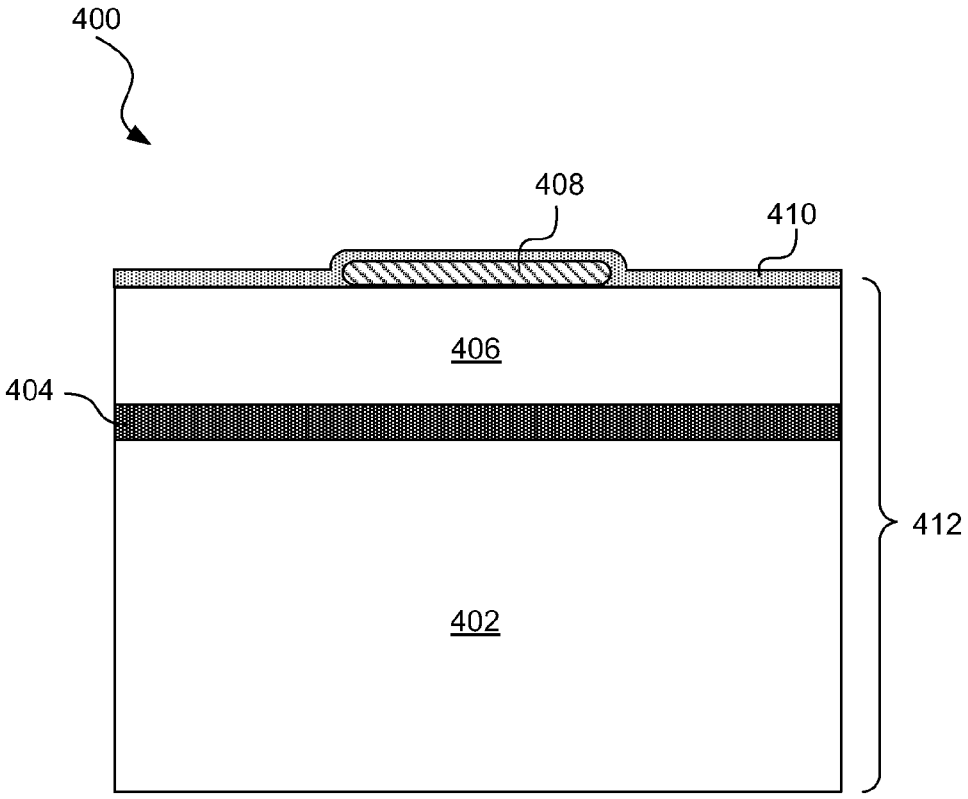
FIG. 4A is a diagram showing an illustrative cross-sectional view of an ink nozzle formed on a substrate with a stopping layer, according to one example of principles described herein.

FIG. 4A is a diagram showing an illustrative cross-sectional view (400) of a substrate (412) to be used for creating an ink nozzle array (e.g. 300, FIG. 3). The fabrication process to be described will illustrate the formation of a single ink chamber on the membrane layer above the ink supply trench. According to certain illustrative examples, the substrate includes a membrane layer (406) and a handle layer (402). A stopping layer (404) is disposed between the membrane layer (406) and the handle layer (402). A circuitry layer (410) is then deposited on the membrane layer (406) of the substrate (412). The circuitry layer includes resistors (408) where ink chambers are to be placed. The following will describe these layers in more detail.

Ink nozzles are typically formed onto a semiconductor substrate such as silicon. This substrate is often referred to as a wafer or a die. Use of a semiconductor material for building ink nozzles allows formation of the circuitry which selects and causes ink to be fired from an ink nozzle. Particularly, the semiconductor material is used to form transistor devices which can act as switches or amplifiers used in the circuitry.

The stopping layer (404) is placed between the handle layer (406) and the membrane layer (406). The stopping layer (404) is sometimes referred to as a buried oxide layer. The stopping layer can be made of an oxide material such as silicon dioxide. During the etching process, which will be described in more detail below, the stopping layer (404) is etched away at a slower rate. This allows for the creation of cleaner edges by making it easier to time the etching process.

The membrane layer (406) is also made of a semiconductor material. For example, the membrane layer (406) may be made of silicon. The thickness of the membrane layer may range from 10-50 micrometers (μm). The membrane layer (406) provides semiconductor locations for placing ejection mechanisms and other circuitry elements despite the removal of the semiconductor wafer (402) below.

In the present example, a resistor (408) is used as an ejection mechanism. The resistor (408) receives a firing signal via the circuitry within the thin film circuitry layer (410). As mentioned above, the thin film circuitry layer may include conductive traces which carry electrical signals to the resistors (408). Other types of ejection mechanisms may be used as well. For example, a piezoelectric inkjet system propels ink droplets out of an ink chamber by applying a voltage across a piezoelectric film bordering the ink within the chamber. The piezoelectric film realigns its molecules under an applied voltage. This causes the film, to expand and propel ink out of the nozzle. The piezoelectric film may be placed in a similar position as the resistors of a thermal inkjet ink chamber.

Semiconductor substrates (412) that include a second material disposed between two semiconductor materials are sometimes manufactured in bulk to be used for a variety of other purposes. These types of substrates are often referred to as a silicon-on-insulator substrate. An ink nozzle embodying principles described herein may make use of such prefabricated silicon-on-insulator substrates. For example, a prefabricated silicon-on-insulator substrate may include two semiconductor layers with an insulating layer in between those two layers. The insulating layer can be used as a stopping layer. Additionally, one of the layers can be ground down to the appropriate thickness to form the membrane layer.

Figure 4B:
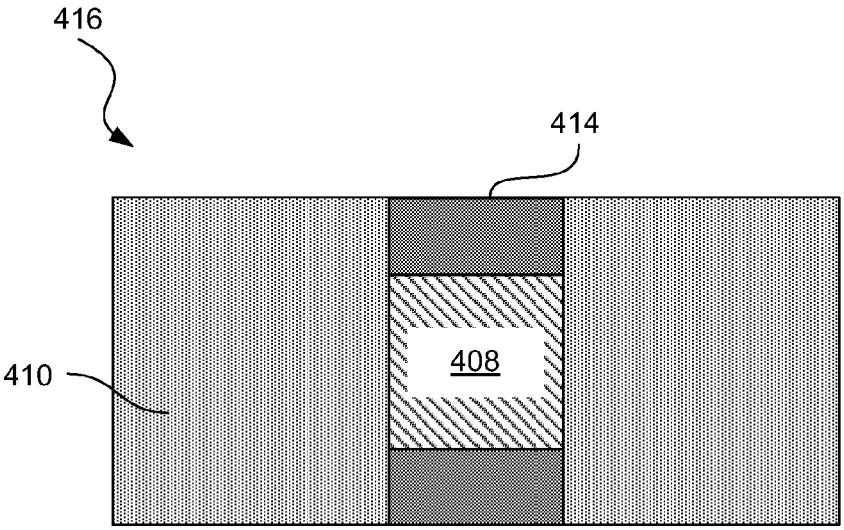
FIG. 4B is a diagram showing an illustrative top view of the ink nozzle of FIG. 4A, according to one example of principles described herein.

FIG. 4B is a diagram showing an illustrative top view of the ink nozzle of FIG. 4A. The resistor (408) is shown through the circuitry layer (410). In addition, conductive traces (414) are shown extending from two opposing sides of the resistor (408). This leaves the remaining sides of the resistor (408) for the placement of ink feedholes which will be discussed below.

Figure 5A:
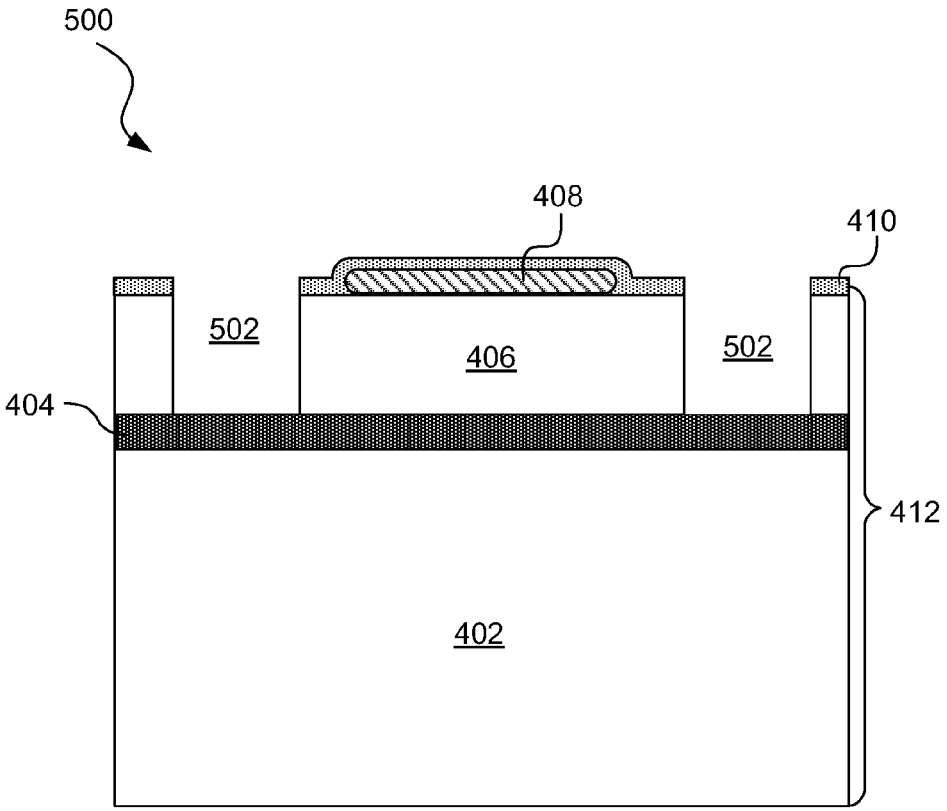
FIG. 5A is a diagram showing an illustrative cross-sectional view of an ink nozzle formed on a substrate with a stopping layer, according to one example of principles described herein.

FIG. 5A is a diagram showing an illustrative cross-sectional view of a substrate (412) with a stopping layer (404) after ink feedholes (502) have been formed. According to certain illustrative examples, ink feedholes (502) are formed through the membrane layer (406). These ink feedholes (502) provide a channel for ink to flow into an ink chamber after that ink chamber is fired.

The ink feedholes (502) can be formed through various photolithographic and etching processes. Through these processes, a mask is used to determine where etching should occur. This mask can be designed so that the etching occurs at the appropriate locations. The etching process continues until the stopping layer (404) is reached. As mentioned above, the stopping layer (404) etches away at a much slower rate than then the membrane layer (406). This makes it easier to time the etching process so that the ink feedholes (502) are formed at the proper depth.

Figure 5B:
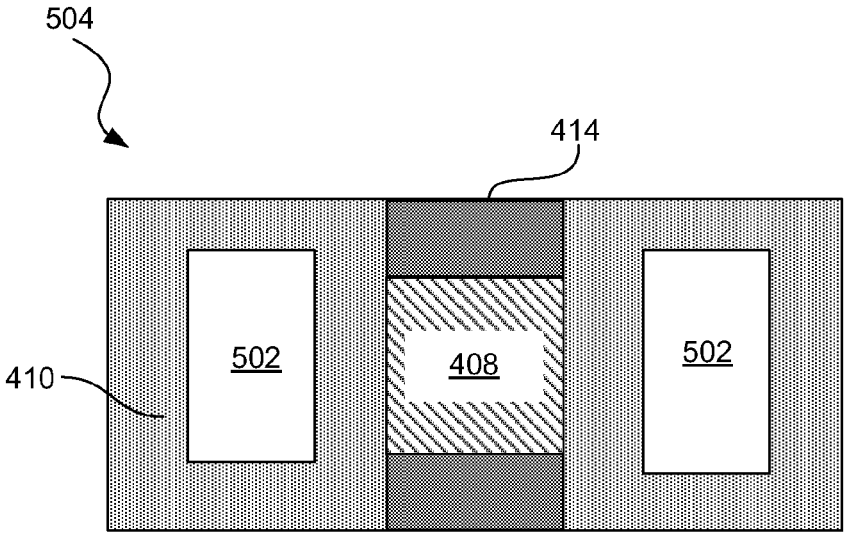
FIG. 5B is a diagram showing an illustrative top view of the ink nozzle of FIG. 5A, according to one example of principles described herein.

FIG. 5B is a diagram showing an illustrative top view of the semiconductor wafer (402) of FIG. 5A. The ink feedholes (502) are shown near the resistor (408) on opposing sides. The ink feedholes (502) also cut through the circuitry layer (410). Although the ink feedholes (502) are shown having a rectangular shape, the ink feedholes may be any other practical shape such as circular or square.

Figure 6:
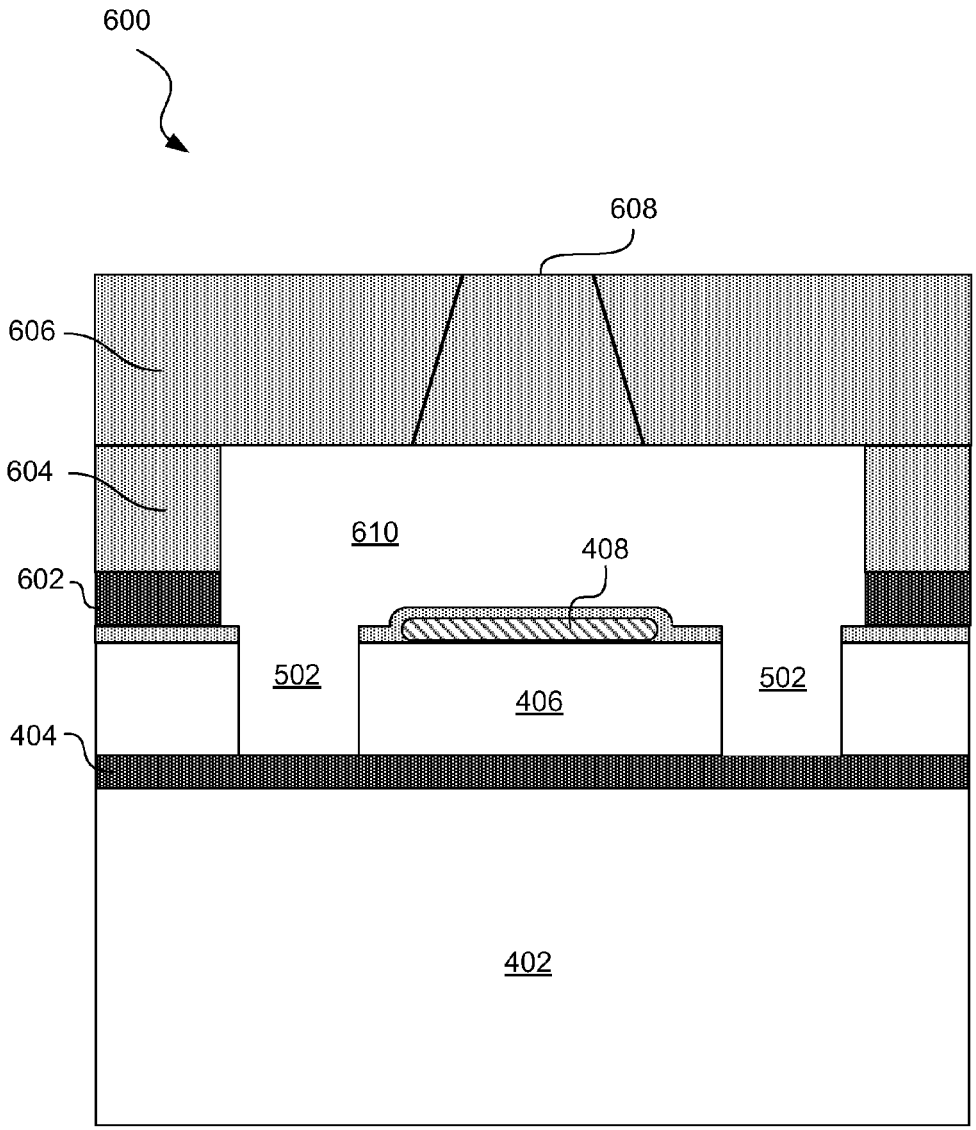
FIG. 6 is a diagram showing an illustrative cross-sectional view of an ink nozzle array formed on a substrate with a stopping layer, according to one example of principles described herein.

FIG. 6 is a diagram showing an illustrative cross-sectional view (600) of an ink nozzle array having a substrate with a stopping layer (404) and an ink chamber (610) formed onto the substrate. According to certain illustrative embodiments, the ink chamber (610) is formed above the resistor (408). The ink chamber can be formed using a photosensitive polymer of which multiple layers can be sequentially deposited, patterned, and developed to create the appropriate geometry. A primer material (602) can be deposited onto the surface of the circuitry layer (410). The primer material (602) acts as an adhesive layer for the subsequently placed polymer material used to form the chamber walls (604) and the top hat layer (606). The top hat layer (606) is perforated with ink nozzles (608).

For purposes of illustration, the process described in the text accompanying FIGS. 4A, 4B, 5A, 5B, and 6 shows the formation of a single ink chamber above the membrane layer. However, this same fabrication process can be applied to create multiple ink chambers formed across the width of an ink supply trench as illustrated in FIG. 3A.

Figure 7:
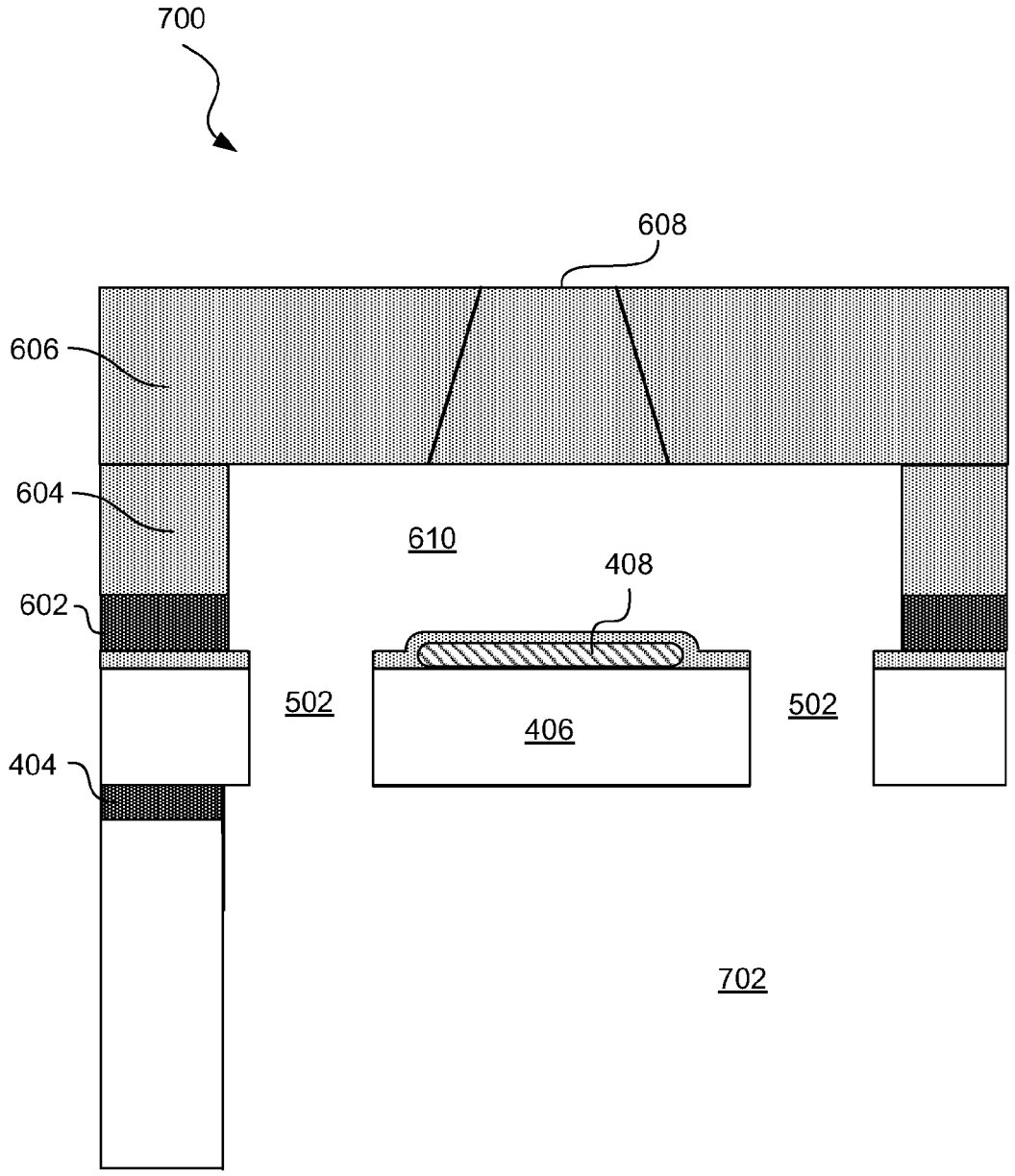
FIG. 7 is a diagram showing an illustrative cross-sectional view of an ink nozzle array formed on a substrate with a stopping layer, according to one example of principles described herein.

FIG. 7 is a diagram showing an illustrative cross-sectional view (700) of an ink nozzle array after an ink supply trench has been formed. FIG. 7 illustrates one of several ink chambers placed above and across the width of the ink supply trench (702). According to certain illustrative examples, the ink supply trench (702) is formed by an etching process as well. Various etching techniques may be used such as dry etching and laser etching. The ink supply trench (702) is cut all the way from the surface of the handle layer (402) to the stopping layer (404). At this point, the etching process then proceeds with a type of etch that is selective to the stopping layer (404). This etching continues until the stopping layer is removed and the ink feedholes (502) have a clean opening to the ink supply trench (702).

In some cases, ink feedholes (502) can be formed on more than one side of the resistor (408). FIG. 7 and previous figures illustrate two ink feedholes (502) formed on opposing sides of the resistor (408). This formation allows for faster refilling of the ink chamber after the ink chamber is fired. The faster flow of ink through the ink feedholes (502) also increases the thermal efficiency of the ink nozzle array. This is because the faster ink flow of the ink nozzle array conducts more heat away from the semiconductor material forming the ink nozzle array. The heat leaves the ink nozzle array though the ink droplets which are propelled out of the nozzles.

Figure 8:
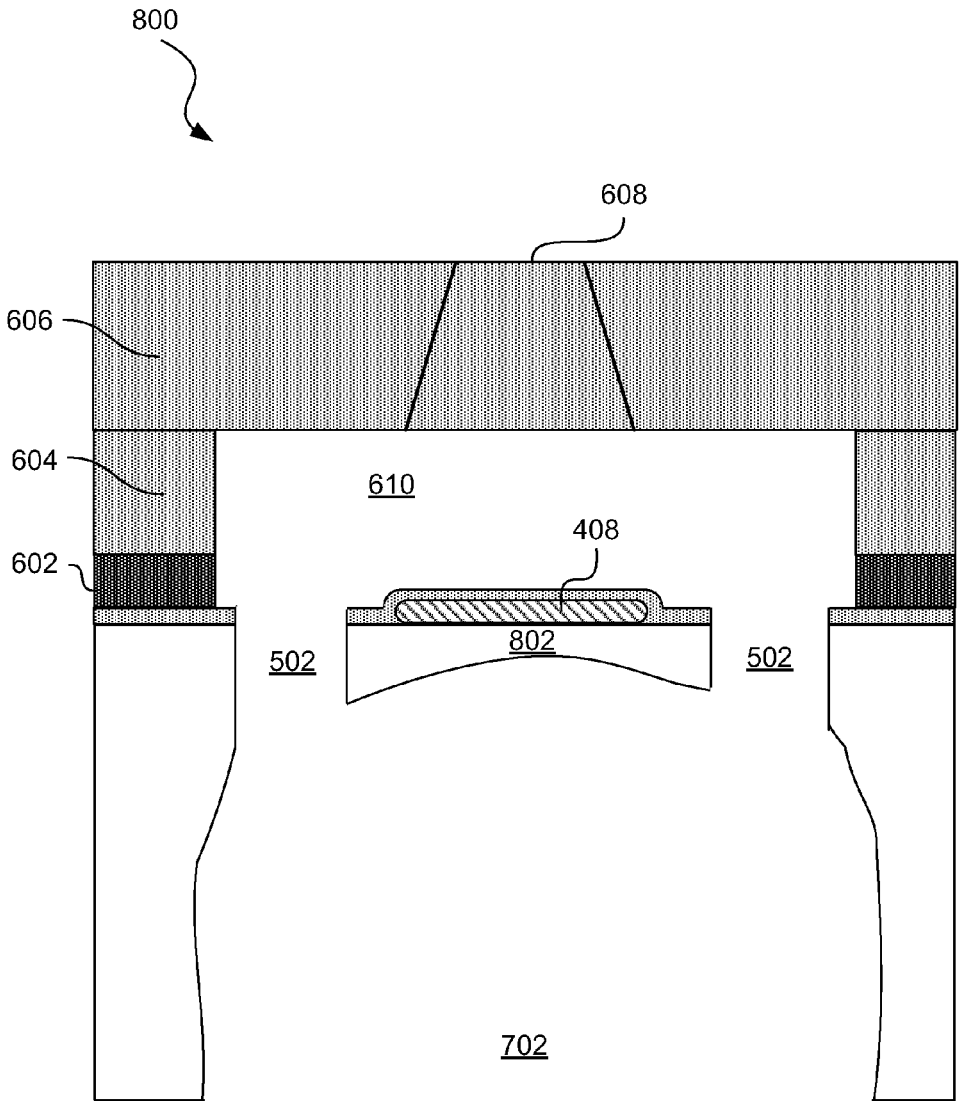
FIG. 8 is a diagram showing an illustrative cross-sectional view of an ink nozzle array formed on a substrate without a stopping layer, according to one example of principles described herein.

FIG. 8 is a diagram showing an illustrative cross-sectional view of an ink nozzle array formed on a substrate without a stopping layer. Without a stopping layer, the etching process leaves a non-uniform piece of silicon (802). This non-uniform silicon (802) is relatively fragile and less durable. Non-uniformities in the silicon (802) can lead to thermal and fluidic variations. These variations cause inefficiencies in the performance of the ink nozzle array. The problems caused by non-uniform ink feedholes (502) and ink supply trench are exacerbated as the silicon (802) supports multiple ink chambers (700) across the width of the ink supply trench (702).

Figure 9:
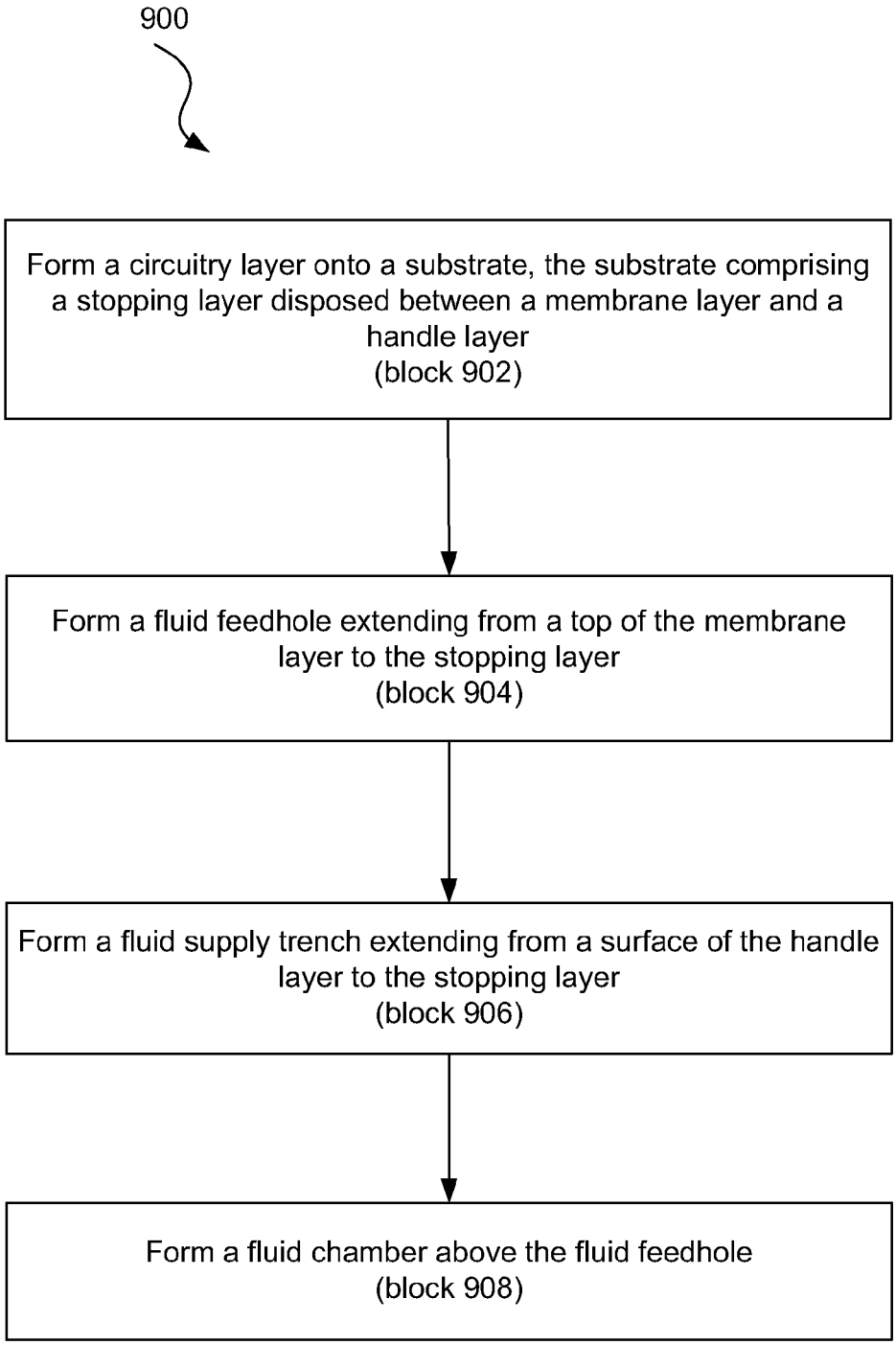
FIG. 9 is a flowchart showing an illustrative method for fabricating an ink nozzle array, according to one example of principles described herein.

FIG. 9 is a flowchart showing an illustrative method for fabricating an ink nozzle array. According to certain illustrative examples, the method includes forming (block 902) a circuitry layer onto a substrate, the substrate including a stopping layer disposed between a membrane layer and a handle layer, forming (block 904) a fluid feedhole extending from a top of the membrane layer to the stopping layer, forming (block 906) a fluid supply trench extending from a surface of the handle layer to the stopping layer, and forming (block 908) an ink chamber above the ink feedhole.

In conclusion, through use of the membrane layer described herein, a two-dimensional array of ink chambers may be placed above and use the same ink supply trench. The semiconductor material making up the membrane layer allows for circuitry to be formed for connecting to and engaging the ejection mechanism associated with each ink chamber. By having two dimensions of ink chambers placed above and sharing the same ink supply trench, a greater ink nozzle density can be achieved. Additionally, more freedom is given to space the ink nozzles in a thermally efficient manner.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for fabricating a fluid nozzle array, the method comprising:

forming a circuitry layer onto a substrate, said substrate comprising a stopping layer disposed between a membrane layer and a handle layer;

forming a fluid feedhole extending from a surface of said membrane layer to said stopping layer; and forming a fluid supply trench extending from a surface of said handle layer to said stopping layer.

2. The method of claim 1, in which said fluid supply trench is formed beneath a number of fluid feedholes along a width of said fluid supply trench.

3. The method of claim 1, further comprising forming a fluid chamber above said fluid feedhole.

4. The method of claim 3, in which said fluid chamber comprises:

a fluid nozzle;

a fluid ejection mechanism; and at least two fluid feedholes formed on separate sides of said fluid ejection mechanism.

5. The method of claim 4, in which said fluid ejection mechanism is one of: a thermal resistor and a piezoelectric actuator.

6. The method of claim 1, in which said stopping layer etches away differently than one of said handle layer and said membrane layer.

7. The method of claim 1, in which said substrate comprises a prefabricated silicon-on-insulator material.

8. A fluid nozzle array comprising:

a substrate comprising:

a membrane layer;

a stopping layer adjacent to said membrane layer; and a handle layer adjacent to said stopping layer;

a set of fluid chambers disposed on a surface of said membrane layer above and along a width of a fluid supply trench extending from a surface of said handle layer to said stopping layer.

9. The array of claim 8, further comprising, forming additional sets of fluid chambers disposed on a surface of said membrane layer above and along said width of said fluid supply trench, said additional sets of fluid chambers disposed along a length of said fluid supply trench form a two-dimensional array.

10. The array of claim 8, in which one of said fluid chambers comprises:

a fluid nozzle;

a fluid ejection mechanism; and a fluid feedhole through said membrane layer and said stopping layer to said fluid supply trench.

11. The array of claim 10, in which said one of said fluid chambers comprises additional fluid feedholes, said additional fluid feedholes formed on separate sides of said fluid ejection mechanism.

12. The array of claim 10, in which said fluid ejection mechanism is one of: a thermal resistor; and a piezoelectric actuator.

13. The array of claim 8, in which said stopping layer etches away differently than one of said handle layer and said membrane layer.

14. The array of claim 8, in which said substrate comprises a prefabricated silicon-on-insulator material.

15. A two-dimensional fluid nozzle array comprising:

a stopping layer disposed between a membrane layer and a handle layer, said membrane layer spanning across a fluid supply trench, said fluid supply trend formed into said handle layer;

a plurality of sets of fluid chambers disposed on a surface of said membrane layer above and along a length of said fluid supply trench;

in which a set of fluid chambers comprises a number of fluid chambers above and along a width of said fluid supply trench.

* * * * *

UNITED STATES PATENT AND TRADEMARK OFFICE

CERTIFICATE OF CORRECTION

PATENT NO. : 8,690,295 B2
APPLICATION NO. : 13/821204
DATED : April 8, 2014
INVENTOR(S) : Bengali et al.

It is certified that error appears in the above-identified patent and that said Letters Patent is hereby corrected as shown below:

In the Claims

Column 8, line 56, Claim 9, after “trench” insert -- to --.

Column 9, line 12, Claim 15, delete “trend” and insert -- trench --, therefor.

Signed and Sealed this
Twenty-ninth Day of July, 2014

Michelle K. Lee

Michelle K. Lee
*Deputy Director of the United States Patent and Trademark Office*